US007993118B2

(12) United States Patent
Prior et al.

(10) Patent No.: US 7,993,118 B2
(45) Date of Patent: Aug. 9, 2011

(54) LIQUID-COOLED ROTOR ASSEMBLY FOR A SUPERCHARGER

(75) Inventors: Gregory P. Prior, Birmingham, MI (US); Roxann M. Bittner, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 751 days.

(21) Appl. No.: 11/768,598

(22) Filed: Jun. 26, 2007

(65) Prior Publication Data

US 2009/0004038 A1 Jan. 1, 2009

(51) Int. Cl.

| | |
|---|---|
| ***F04C 27/02*** | (2006.01) |
| ***F04C 29/02*** | (2006.01) |
| ***F04C 29/04*** | (2006.01) |

(52) U.S. Cl. ..... 418/91; 418/99; 418/102; 418/201.1

(58) Field of Classification Search ..... 418/15, 418/91, 94, 99, 102, 201.1, 206.1, 206.3
See application file for complete search history.

(56) References Cited

U.S. PATENT DOCUMENTS

| | | | | |
|---|---|---|---|---|
| 3,299,862 | A * | 1/1967 | Peras | 418/91 |
| 4,005,955 | A | 2/1977 | Pamlin | |
| 6,045,343 | A * | 4/2000 | Liou | 418/91 |
| 6,758,660 | B2 * | 7/2004 | Kriehn et al. | 418/91 |
| 6,884,050 | B2 | 4/2005 | Prior | |
| 2008/0170958 | A1 | 7/2008 | Prior | |

* cited by examiner

*Primary Examiner* — Theresa Trieu
(74) *Attorney, Agent, or Firm* — Quinn Law Group, PLLC

(57) ABSTRACT

A rotor assembly for a supercharger assembly is provided. The rotor assembly includes at least one lobe defining at least one cavity. The at least one cavity is configured to contain a fluid operable to cool the at least one lobe. A supercharger incorporating the rotor assembly is also disclosed.

11 Claims, 4 Drawing Sheets

LIQUID-COOLED ROTOR ASSEMBLY FOR A SUPERCHARGER

TECHNICAL FIELD

The present invention relates to a liquid-cooled rotor assembly for a compressor or supercharger assembly.

BACKGROUND OF THE INVENTION

Roots-type and screw-type positive displacement compressors are employed in industrial and automotive applications. The compressor or supercharger may be operatively connected to an internal combustion engine to increase the volume of intake air communicated to the internal combustion engine thereby increasing the volumetric efficiency thereof. The supercharger typically includes two interleaved and counter-rotating rotors each of which may be formed with a plurality of lobes to convey intake air for subsequent introduction to the internal combustion engine. The efficiency of the supercharger is dependent on the running clearances between each of the two rotors and a housing within which the two rotors are rotatably supported.

SUMMARY OF THE INVENTION

A rotor assembly for a supercharger assembly is provided. The rotor assembly includes at least one lobe defining at least one cavity. The at least one cavity is configured to contain a fluid, such as oil or coolant, operable to cool the at least one lobe.

In one embodiment, the rotor assembly includes a rotatable shaft member and the at least one lobe is operatively connected to the shaft member. The shaft member defines a feed passage operable to communicate the fluid to the at least one cavity. The shaft member further defines a return passage operable to exhaust the fluid from the at least one cavity. The feed passage is positioned generally along an axis of rotation of the shaft member, while the return passage is positioned generally adjacent to the outer periphery of the shaft member. A supercharger incorporating the rotor assembly is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
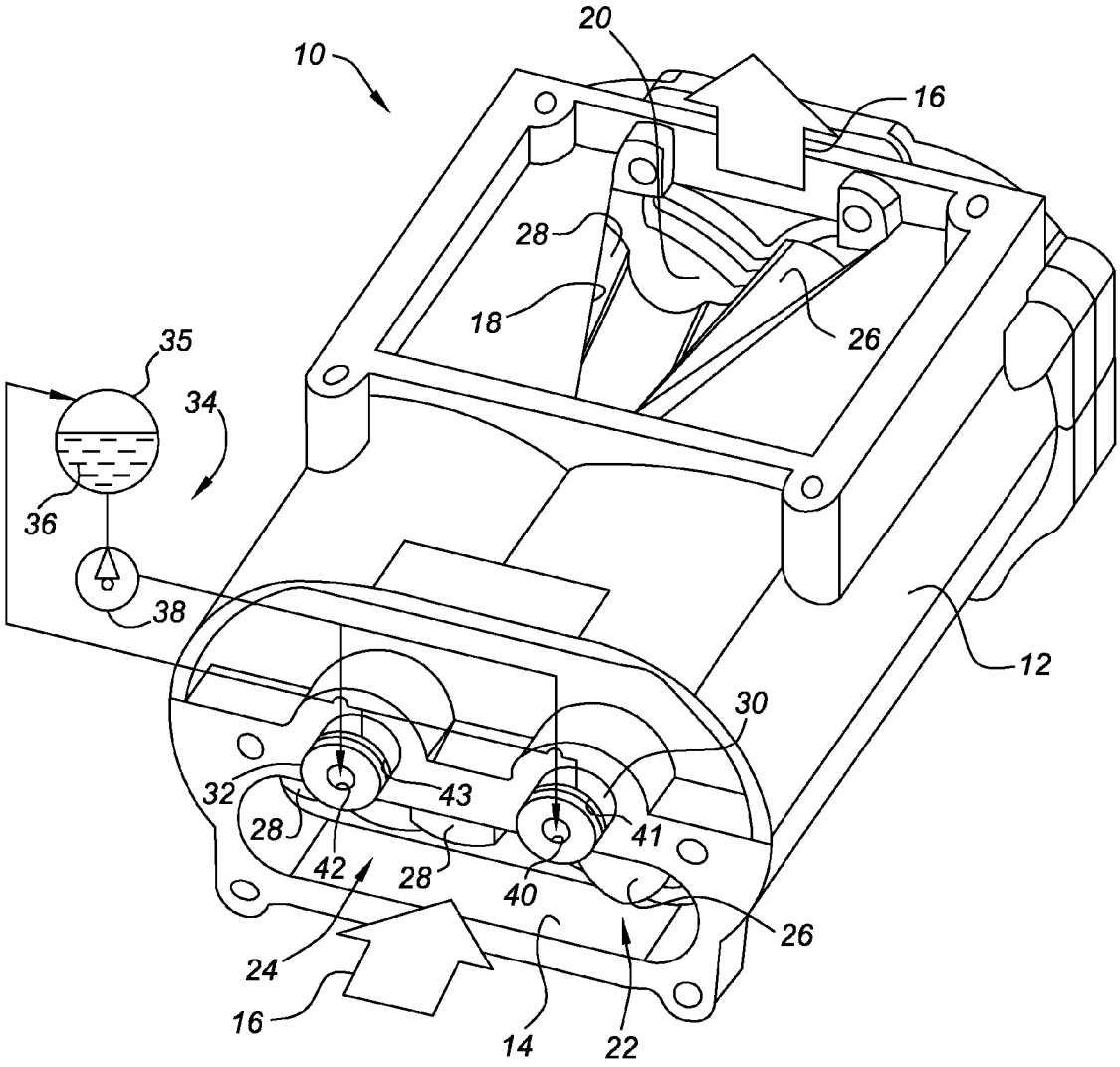
FIG. 1 is a schematic perspective view of a supercharger assembly configured for use with an internal combustion engine.

Referring to the drawings wherein like reference numbers correspond to like or similar components throughout the several figures, there is shown in FIG. 1 a compressor or supercharger assembly, generally indicated at 10. The supercharger assembly 10 includes a housing 12. The housing 12 defines an inlet passage 14 configured to induct intake air, represented as arrow 16, into the supercharger assembly 10. The housing 12 further defines an outlet passage 18 configured to exhaust the intake air 16 from the supercharger assembly 10.

A rotor cavity 20 is defined by the housing 12 and is configured to contain a first and second rotor assembly 22 and 24, respectively, rotatably disposed therein. The first and second rotor assemblies 22 and 24 are interleaved and counter-rotating with respect to each other. The first rotor assembly 22 includes a plurality of lobes 26 extending radially outward in a clockwise twisting helical shape, as viewed from the inlet passage 14, while the second rotor assembly 24 includes a plurality of lobes 28 extending radially outward in a counter-clockwise twisting helical shape, as viewed from the inlet passage 14. The first and second rotor assemblies 22 and 24 cooperate to convey intake air 16 from the inlet passage 14 to the outlet passage 18. The first and second rotor assemblies 22 and 24 are rotatably supported within the rotor cavity 20 by respective first and second shaft member 30 and 32.

During operation of the supercharger assembly 10, the first and second rotor assemblies 22 and 24 cooperate to convey intake air 16 from the inlet passage 14 to the outlet passage 18. The temperature of the intake air 16 tends to increase as the intake air 16 is transferred from the inlet passage 14 to the outlet passage 18, thereby forming a thermal gradient along the longitudinal axis of the first and second rotors 22 and 24. As a result, the degree of thermal expansion of the first and second rotor assemblies 22 and 24 will increase during operation of the supercharger assembly 10, thereby increasing the likelihood of "scuff". Scuff is defined as metal transfer as a result of the first and second rotor assemblies 22 and 24 contacting one another or the housing 12. Scuff occurs when the running clearances, i.e. the clearance dimension between the lobes 26 and 28 and the housing 12 when the supercharger assembly 10 is operating, reaches zero causing an interference condition and material transfer between the first and second rotor assemblies 22 and 24 and the housing 12.

A cooling system 34, such as a loop or a simple tank, is schematically depicted in FIG. 1 and is operable to cool or extract heat energy from the lobes 26 and 28 of the first and second rotor assemblies 22 and 24 during the operation of the supercharger assembly 10. By cooling the lobes 26 and 28, the thermal expansion of the first and second rotor assemblies 22 and 24 can be minimized thereby reducing the likelihood of scuff. Additionally, the cooling system 34 enables tighter running clearances between the first and second rotor assemblies 22 and 24 and the housing 12 since the dimensional stability of the lobes 26 and 28 during operation of the supercharger assembly 10 is improved. The cooling system 34 includes a source 35 of fluid 36, such as oil from a gear case (not shown) of the supercharger assembly 10, or coolant from a liquid-to-air supercharger intercooler (not shown) or the engine (not shown), or a completely separate fluid circuit; however, those skilled in the art will recognize other fluids that may be used within the cooling system 34 while remaining within the scope of that which is claimed. A pump 38 is in fluid communication with the source 35 and is operable to communicate the fluid 36 under pressure to feed passages 40 and 42 defined by respective first and second shaft members 30 and 32 to effect cooling of the first and second rotor assemblies 22 and 24. Annular grooves 41 and 43 are partially defined by the respective first and second shaft members 30 and 32. The annular grooves 41 and 43 are operable to return the fluid 36 to the source 35.

Figure 2:
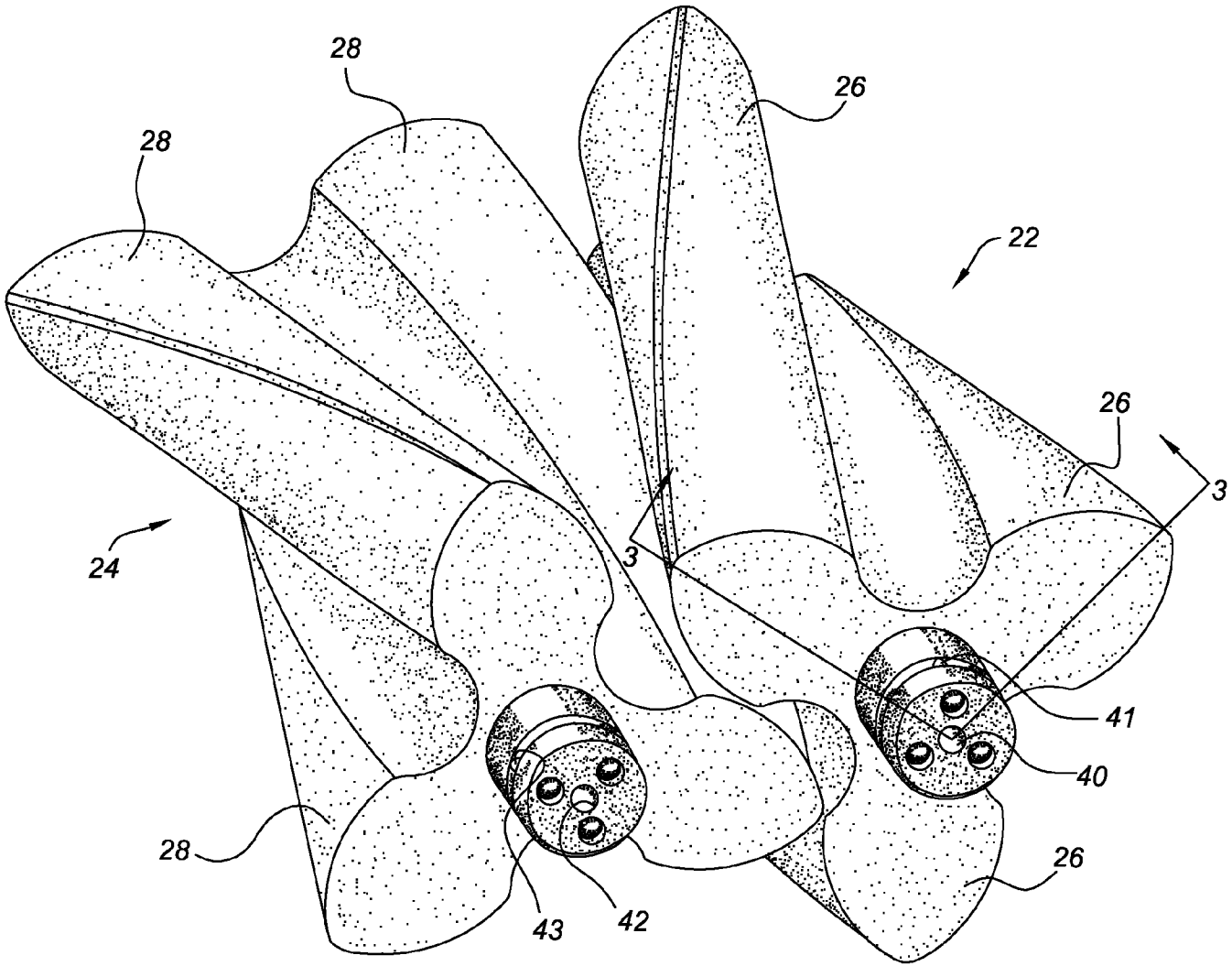
FIG. 2 is a perspective view of a first and second rotor assembly for use within the supercharger assembly of FIG. 1.

Referring to FIG. 2, there is shown a perspective view of the first and second rotor assemblies 22 and 24 illustrating in greater detail the generally helical shape of the lobes 26 and 28. Additionally, the feed passages 40 and 42 and the annular grooves 41 and 43.

Figure 3:
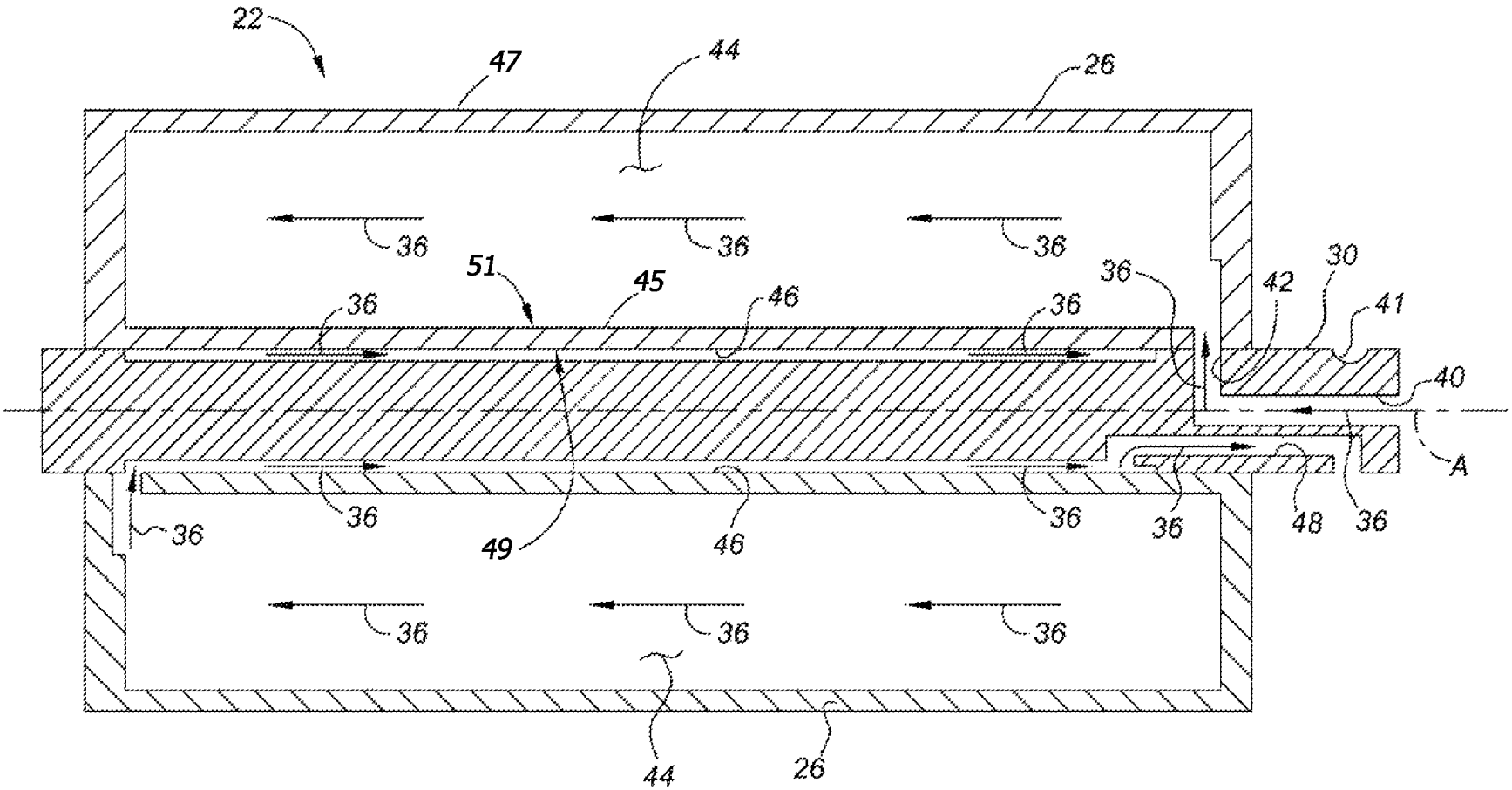
FIG. 3 is a non-planar or revolved cross sectional view, taken along 3-3 of FIG. 2, of two adjacent lobes of the first rotor assembly.

The structure and operation of the first and second rotor assemblies 22 and 24 will be discussed in greater detail with reference to FIG. 3. Although only the first rotor assembly 22 is shown in FIG. 3, it should be understood that the same general structure may be employed with the second rotor assembly 24. Referring to FIG. 3 and with continued reference to FIG. 1, there is shown a non-planer cross sectional view of the first rotor assembly 22. The section is taken along 3-3 of FIG. 2 and generally rotates with the helix angle of lobes 26. The first shaft member 30 is rotatable about an axis of rotation, indicated at A. The feed passage 40 extends generally along the axis of rotation A and is in communication with a generally radially extending passage 42 defined by the first shaft member 30. The radially extending passage 42 is in communication with a cavity 44 defined by the lobe 26. Specifically, the cavity 44 is defined by a radially-inner wall 45 of the lobe 26 and a radially-outer wall 47 of the lobe 26. The cavity 44 extends radially between the radially-inner wall 45 and the radially outer wall 47. Although only one radially extending passage 42 is shown in FIG. 3, it should be understood that each of the cavities 44 defined by lobes 26 are in communication with a respective radially extending passage 42. The lobes 26 and the first shaft member 30 cooperate to define a generally annular passage 46. The annular passage 46 extends axially along the first shaft member 30 on an opposing side 49 of the radially-inner wall 45 than the side 51 of the radially-inner wall 45 that the cavity 44 is on, and is in communication with a return passage 48 defined by the first shaft member 30. The return passage 48 extends generally axially along the outer periphery of the first shaft member 30.

During operation of the supercharger assembly 10 of FIG. 1, the cooling system 34 provides fluid 36, indicated as arrows in FIG. 3, to the feed passage 40. The fluid 36 is forced radially outward, through the radially extending passage 42, and into the cavity 44. The fluid 36 is at least partially forced radially outward by the centrifugal forces exerted thereon by the rotation of the first shaft member 30. Subsequently, the fluid 36 travels the length of the cavities 44 to extract heat energy and thereby cool the lobes 26 of the first rotor assembly 22. The fluid 36, having traveled the length of the lobes 26, is exhausted into the generally annular passage 46 where the fluid is communicated to the return passage 48 for later communication to the cooling system 34. The annular groove 41 is defined by the first shaft member 30 and is operable to facilitate the exhausting of fluid 36 from the return passage 48.

By cooling the lobes 26 and 28, the running clearances between the lobes 26 and 28 and the housing 12 may be minimized while reducing the likelihood of scuff. Therefore, the operating efficiency of the supercharger assembly 10 may be increased by maintaining the temperature of lobes 26 and 28 within predetermined limits. It should be understood that with certain configurations of the first rotor assembly 22 and operating speeds of the supercharger assembly 10, the pump 38 may not be necessary since the feed passage 40 is centrally located along the axis of rotation A of the first shaft member 30, while the return passage 48 is provided on the outer periphery of the first shaft member 30. As such, the centrifugal forces exerted on the fluid 36 by the rotation of the first shaft member 30 may be sufficient to enable the pumping of the fluid 36 through the first rotor assembly 22 in lieu of the pump 38. The first and second rotor assemblies 22 and 24 may have helical-type, screw-type, or straight-type configurations for lobes 26 and 28 while remaining within the scope of that which is claimed. As stated hereinabove, the lobes 26 and 28 of the first and second rotor assemblies 22 and 24 have a generally helical shape; as such, the fluid 36 is pumped through the cavities 44 during rotation of the first and second rotor assemblies 22 and 24.

Figure 4:
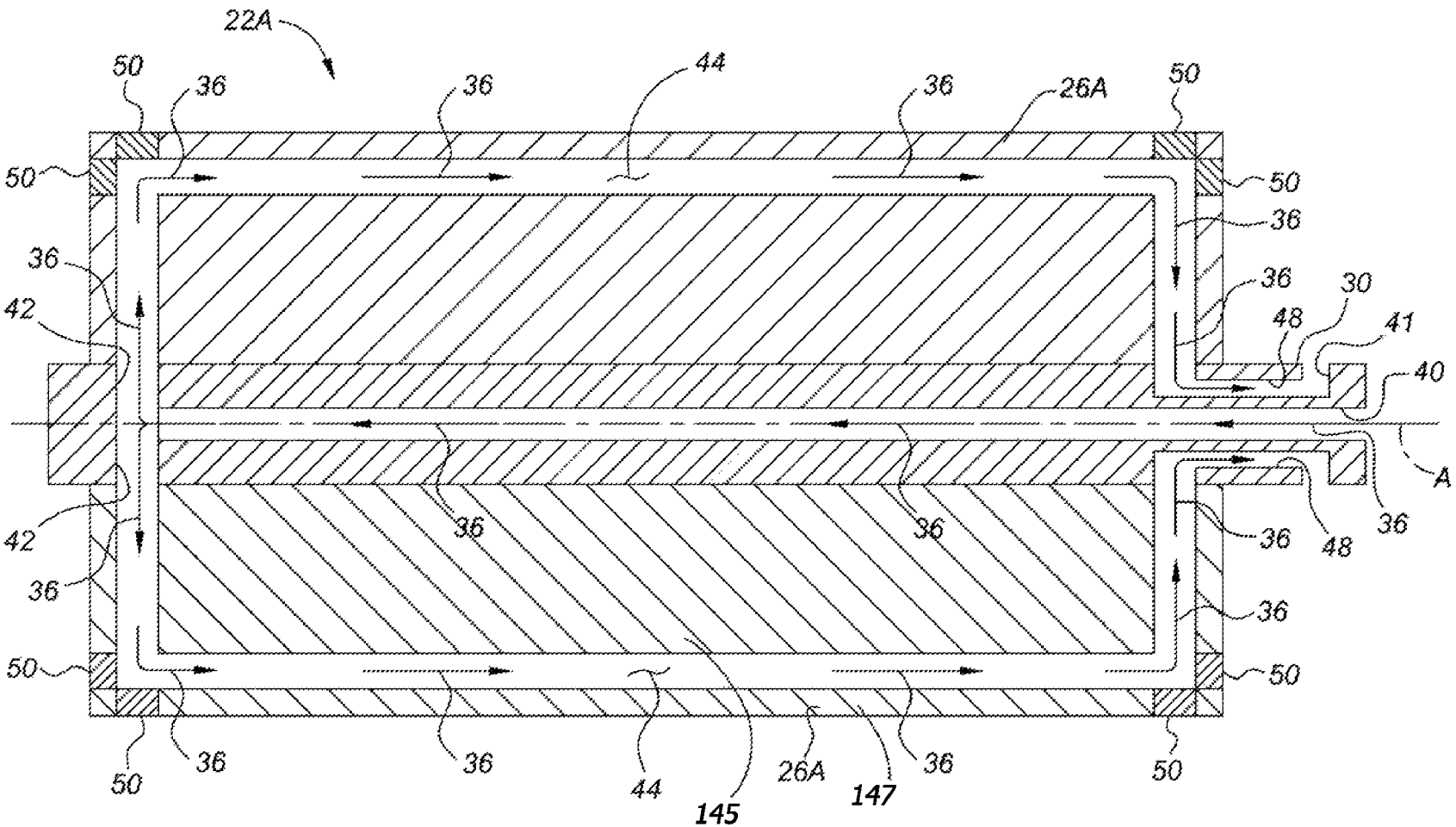
FIG. 4 is a non-planar or revolved cross sectional view, similar to that of FIG. 3, of an alternate embodiment of the first rotor assembly of FIGS. 1-3.

Referring to FIG. 4, there is shown an alternate embodiment of the first rotor assembly 22 of FIGS. 1 through 3, generally indicated at 22A. The first rotor assembly 22A is similar to the first rotor assembly 22; however the cavity 44 is formed by cross drilling lobes 26A. The cavity 44 is defined by a radially-inner wall 145 of the lobe 26A and a radially-outer wall 147 of the lobe 26A. The cavity 44 extends radially between the radially-inner wall 145 and the radially-outer wall 147. Plugs 50, such as cup plugs or ball bearings, are mounted to the lobes 26A and are operable to prevent leakage of fluid 36 from the cavity 44 during operation of the first rotor assembly 22A. By cross-drilling the lobes 26A, a conventional, i.e. non liquid-cooled rotor assembly may be adapted to a liquid cooled rotor assembly. Additionally, cavities 44 may be easier to form within certain rotor shapes, such as helix shapes, by cross drilling as opposed to investment casting or other casting methods.

In operation of the first rotor assembly 22A, the fluid 36 is communicated to the feed passage 40 and is subsequently communicated to the cavities 44 via the radially extending passages 42. As with the first rotor assembly 22 of FIG. 3, the fluid 36 travels the length of the cavities 44 to extract heat energy and thereby cool the lobes 26A of the first rotor assembly 22A. The fluid 36, having traveled the length of the lobes 26A, is exhausted into the return passage 48 for later communication to the cooling system 34 via the annular groove 41.

Although the discussion has focused on the application of the supercharger assembly 10 to an internal combustion engine, those skilled in the art will recognize other applications of the supercharger 10 such as a compressor for industrial application, compressor for fuel cell applications, etc. While the best modes for carrying out the invention have been described in detail, those familiar with the art to which this invention relates will recognize various alternative designs and embodiments for practicing the invention within the scope of the appended claims.

The invention claimed is:

1. A rotor assembly for a supercharger assembly comprising:

at least one lobe defining at least one cavity;

wherein said at least one cavity is configured to contain a fluid operable to cool said at least one lobe;

a rotatable shaft member defining an axis of rotation;

wherein said at least one lobe is operatively connected to said shaft member, is helically-shaped with a radially-inner wall and a radially-outer wall defining said at least one cavity such that said at least one cavity extends radially from said radially-inner wall to said radially-outer wall and fluid flows in said at least one cavity in an axial direction between said radially-inner wall and said radially-outer wall; wherein said at least one lobe extends along the axis of rotation; wherein said at least one lobe is operatively connected to said shaft member;

wherein said shaft member defines a feed passage operable to communicate said fluid to said at least one cavity, and defines a return passage operable to exhaust said fluid from said at least one cavity; and wherein said at least one lobe and said shaft member cooperate to define an annular passage extending axially between said shaft member and said radially-inner wall on an opposing side of said radially-inner wall than said at least one cavity and that is operable to communicate said fluid between said at least one cavity and said return passage.

2. The rotor assembly of claim 1, wherein said fluid is one of coolant and oil.

3. The rotor assembly of claim 1, wherein said feed passage is positioned generally along the axis of rotation of said shaft member.

4. The rotor assembly of claim 1, wherein said return passage is positioned generally adjacent to the outer periphery of said shaft member.

5. A supercharger assembly comprising:

a housing defining a rotor cavity;

first and second rotor assemblies rotatably supported within said rotor cavity by respective first and second shaft members each of which defines an axis of rotation;

wherein said first and second rotor assemblies include respectively a first and second plurality of helically-shaped lobes connected to said respective first and second shaft members; each lobe having a radially-inner wall and a radially-outer wall and extending along the respective axis of rotation;

wherein each of said first and second plurality of lobes defines at least one cavity;

wherein said at least one cavity is configured to contain a fluid operable to cool said first and second plurality of lobes and extends radially from said radially-inner wall to said radially-outer wall so that fluid flows in said at least one cavity in an axial direction between said radially-inner wall and said radially-outer wall;

wherein said first and second shaft members each define at least one feed passage operable to communicate said fluid to said at least one cavity of each of said first and second plurality of lobes; wherein said first and second shaft members each define a respective return passage operable to exhaust said fluid from said at least one cavity of each of said at first and second plurality of lobes; and wherein said first and second plurality of lobes and said respective first and second shaft members cooperate to define a respective annular passage extending axially between said respective first and second shaft members and said respective inner wall on an opposing side of said respective radially-inner wall than said at least one cavity and that is operable to communicate said fluid between said at least one cavity of each of said first and second plurality of lobes and said return passage.

6. The supercharger assembly of claim 5, wherein said fluid is one of coolant and oil.

7. The supercharger assembly of claim 5, wherein said at least one feed passage of each of said first and second shaft members is positioned generally along said respective axis of rotation of each of said first and second shaft members.

8. The supercharger assembly of claim 5, wherein said respective return passage of each of said first and second shaft members is positioned generally adjacent to a respective outer periphery of each of said first and second shaft members.

9. A rotor assembly for a supercharger assembly comprising:

a rotatable shaft member;

a plurality of generally helically-shaped lobes extending generally radially from said shaft member, each of said plurality of lobes defining at least one cavity and twisting only partly around said shaft member; wherein said at least one cavity of each of said plurality of lobes is cross-drilled;

wherein said at least one cavity of each of said plurality of lobes is configured to contain a fluid operable to cool each of said plurality of lobes;

wherein said shaft member defines at least one feed passage operable to communicate said fluid to said at least one cavity of each of said plurality of lobes; and wherein said shaft member defines a return passage operable to exhaust said fluid from said at least one cavity of each of said plurality of lobes.

10. The rotor assembly of claim 9, wherein said fluid is one of coolant and oil.

11. The rotor assembly of claim 9, wherein said fluid is communicated to said at least one feed passage by a pump.

* * * * *